US007898358B2

(12) United States Patent
Tsukahara

(10) Patent No.: US 7,898,358 B2
(45) Date of Patent: Mar. 1, 2011

(54) MILLIMETER WAVEBAND SWITCH

(75) Inventor: Yoshihiro Tsukahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 209 days.

(21) Appl. No.: 12/177,177

(22) Filed: Jul. 22, 2008

(65) Prior Publication Data

US 2009/0256646 A1 Oct. 15, 2009

(30) Foreign Application Priority Data

Apr. 9, 2008 (JP) ..... 2008-101270

(51) Int. Cl.
*H01P 1/10* (2006.01)
*H01P 1/18* (2006.01)

(52) U.S. Cl. ..... 333/101; 333/103; 333/164

(58) Field of Classification Search ..... 333/101, 333/103, 104, 161, 164
See application file for complete search history.

(56) References Cited

U.S. PATENT DOCUMENTS 5,392,010 A * 2/1995 Nakahara ..... 333/161
5,856,713 A * 1/1999 Huettner et al. ..... 307/125

FOREIGN PATENT DOCUMENTS

JP 11284203 A 10/1999
JP 2004289228 A 10/2004

* cited by examiner

*Primary Examiner*—Dean O Takaoka
(74) *Attorney, Agent, or Firm*—Leydig, Voit & Mayer, Ltd.

(57) ABSTRACT

A millimeter waveband switch which enables high isolation without increasing passing loss, includes a first switching element that is connected in series between input and output terminals through which a signal passes; and a first transmission line having an electrical length of ½ wavelength and which is connected in parallel with the first switching element. Alternatively, the millimeter waveband switch may include: a first switching element having a first end connected in parallel to input and output terminals through which a signal passes; a first transmission line having an electrical length of ½ wavelength which is connected in parallel with the first switching element; and a second transmission line having an electrical length of ¼ wavelength and which is connected between aground and a second end of her first switching element.

7 Claims, 17 Drawing Sheets

MILLIMETER WAVEBAND SWITCH

BACKGROUND OF THE INVENTION

1. Field of the Invention

The present invention relates to a switch that mainly operates on a millimeter waveband.

2. Description of the Related Art

FIGS. 29 and 30 are diagrams showing the general circuit structures of the conventional millimeter waveband switch. In the figures, T denotes a field effect transistor (FET) which is used as a switching element, P1 and P2 are input and output terminals, L1 is a transmission line, V1 is a control voltage supply terminal, and D is a diode.

The switch that operates on the millimeter waveband is generally structured in such a manner that the FET or the diode is arranged in parallel to the transmission line (corresponding to L1 in the figures) through which a signal passes for the purpose of reducing loss when the switch is on.

In the conventional structures, for example, in the case of the structure shown in FIG. 29, the isolation characteristic when the switch is off depends on the on-resistance (Ron) value of the switching element which is arranged in parallel to the transmission line. FIGS. 31 and 32 are diagrams showing the circuit structures of the conventional millimeter waveband switch that aims at high isolation. As shown in FIGS. 31 and 32, it is required that two or more switching elements are arranged in parallel in order to aim at the high isolation.

Also, as the structure of the switch for obtaining the high isolation when the switch is off, there is a structure in which inductance that resonates with an off capacitance when the switch is off at a desired frequency is arranged in series (for example, refer to JP 11-284203 A). FIG. 33 is a diagram showing the circuit structure of the conventional millimeter waveband switch in which the inductance is arranged in series with the switch in order to aim at the high isolation.

However, the conventional art suffers from the following problem.

In the conventional switch having the above circuit structure, the isolation characteristic is improved. However, there arises such a problem that the passing loss increases due to the on-resistance of the switching element when the switch is on.

SUMMARY OF THE INVENTION

The present invention has been made to solve the above problem, and therefore has an object to provide a millimeter waveband switch, which enables high isolation without increasing passing loss.

A millimeter waveband switch according to the present invention includes: a first switching element that is connected in series between input and output terminals through which a signal passes; and a first transmission line having an electric length of ½ wavelength which is connected in parallel to the first switching element.

Moreover, a millimeter waveband switch according to the present invention includes: a first switching element having one end connected in parallel between input and output terminals through which a signal passes; a first transmission line having an electric length of ½ wavelength which is connected in parallel to the first switching element; and a second transmission line having an electric length of ¼ wavelength which is connected between a ground and another end of a parallel circuit including the first switching element and the first transmission line.

According to the present invention, the parallel circuit including the transmission line having an electric length of ½ wavelength and the switching element is connected in parallel or in series between the input and output terminals through which a signal passes, thereby making it possible to obtain the millimeter waveband switch which enables the high isolation without an increase in passing loss.

BRIEF DESCRIPTION OF THE DRAWINGS

In the accompanying drawings:

FIG. 5 shows an example of a frequency characteristic showing calculation results of passing loss when the millimeter waveband switch shown in FIG. 1 according to the first embodiment of the present invention is on;

FIG. 10 shows an example of a frequency characteristic showing calculation results of passing loss when the millimeter waveband switch shown in FIG. 6 according to the first embodiment of the present invention is on;

FIG. 23 shows an example of a frequency characteristic showing calculation results of passing loss when the millimeter waveband switch shown in FIG. 21 according to the first embodiment of the present invention is on;

DETAILED DESCRIPTION OF THE PREFERRED EMBODIMENT

Now, a description is given of a preferred embodiment of a millimeter waveband switch according to the present invention with reference to the drawings.

First Embodiment

Figure 1:
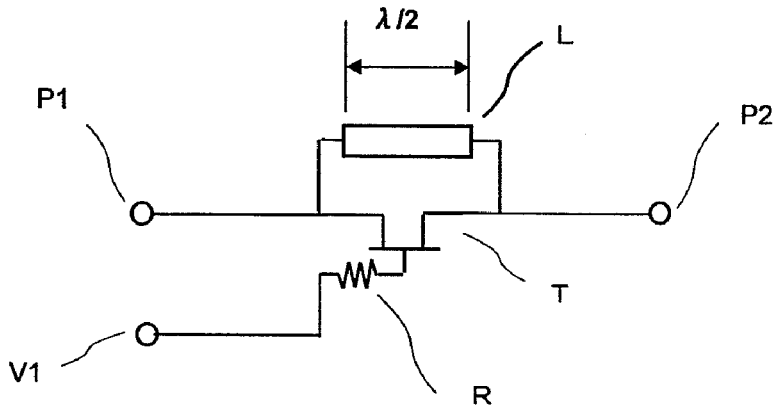
FIG. 1 is a diagram showing a first circuit structure of a millimeter waveband switch according to a first embodiment of the present invention.

FIG. 1 is a diagram showing a first circuit structure of a millimeter waveband switch according to a first embodiment of the present invention. A transmission line having an electric length of ½ wavelength of a millimeter waveband signal passing therethrough is arranged at both ends of a switching element which is arranged in series between input and output terminals (P1 and P2 in the figure). In FIG. 1, L denotes a transmission line of ½ wavelength long, T denotes an FET that operates as the switching element, V1 denotes a control voltage supply terminal, and R denotes a voltage supply resistor.

Figure 2:
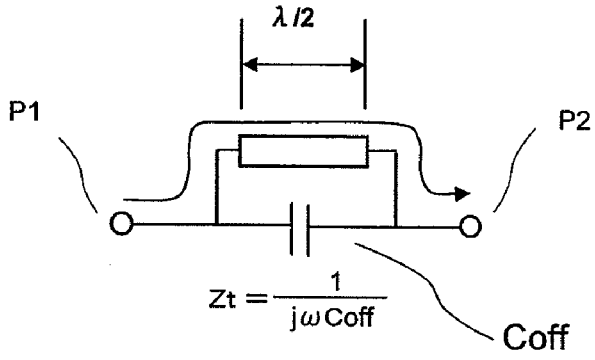
FIG. 2 shows an equivalent circuit of the millimeter waveband switch shown in FIG. 1 when the switch is on in the first embodiment of the present invention.
Figure 3:
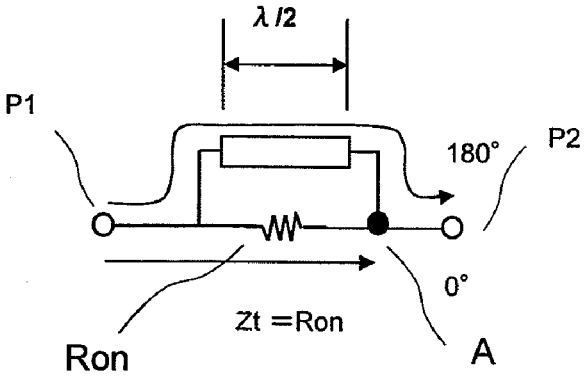
FIG. 3 shows an equivalent circuit of the millimeter waveband switch shown in FIG. 1 when the switch is off in the first embodiment of the present invention.

Hereinafter, a description is given of the operation of the millimeter waveband switch shown in FIG. 1 according to the first embodiment. FIG. 2 shows an equivalent circuit of the millimeter waveband switch shown in FIG. 1 when the switch is on in the first embodiment of the present invention. Also, FIG. 3 shows an equivalent circuit of the millimeter waveband switch shown in FIG. 1 when the switch is off in the first embodiment of the present invention.

When a voltage of Vc<Vp (pinch off voltage of the FET) is applied to the control voltage supply terminal, the FET has a capacitance (Coff) indicated by Coff as shown in FIG. 2, and an impedance Zt of the FET can be represented by the following Expression (1).

$$Zt=1/-j\omega Coff \quad (1)$$

In the case of selecting the FET having a gate width which is small in the off capacitance, the impedance (Zt of FIG. 2) of the FET becomes large on the millimeter waveband which is higher in the frequency, and the millimeter waveband signal passes through the ½ wavelength line.

On the other hand, in the case where a voltage of Vc=0 V is applied to the control voltage supply terminal of the FET when the switch is off, the FET can be regarded substantially as a resistor (Ron of FIG. 3), and the impedance (Zt of FIG. 3) of the FET is represented by the following Expression (2).

$$Zt=Ron \quad (2)$$

In this case, the signals of the millimeter waveband which have been input from P1 are separated into signals that pass through the resistor of Ron and are partially attenuated and signals that pass through the ½ wavelength line and are delayed in phase by 180 degrees. Those signals are combined together at a point A of FIG. 3. Accordingly, because both of those signals operate so as to cancel each other, the high isolation can be realized.

Figure 4:
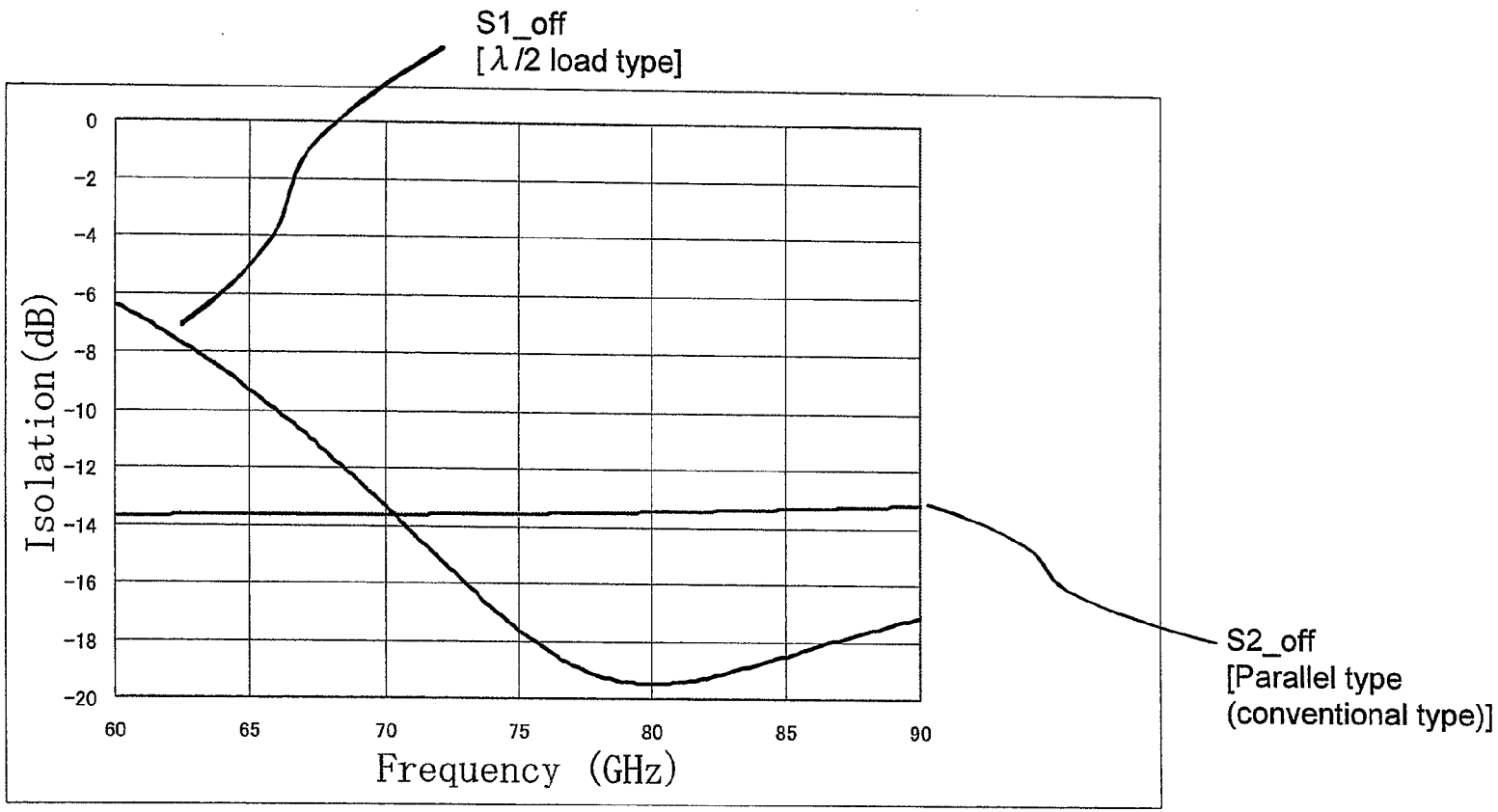
FIG. 4 shows an example of a frequency characteristic showing calculation results of isolation when the millimeter waveband switch shown in FIG. 1 according to the first embodiment of the present invention is off.
Figure 29:
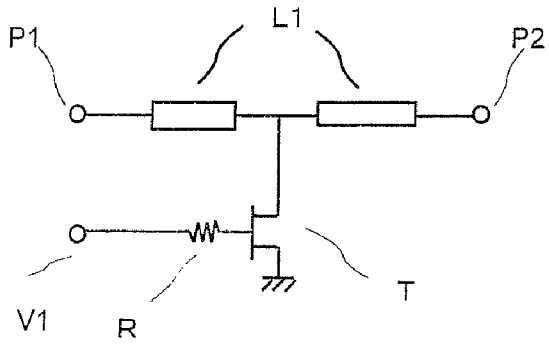
Fig. 29 PRIOR ART
FIG. 29 is a diagram showing a general circuit structure of a conventional millimeter waveband switch.
Figure 30:
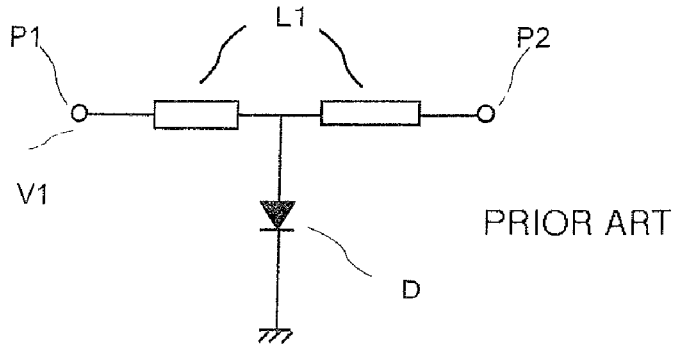
FIG. 30 is a diagram showing a general circuit structure of another conventional millimeter waveband switch.
Figure 31:
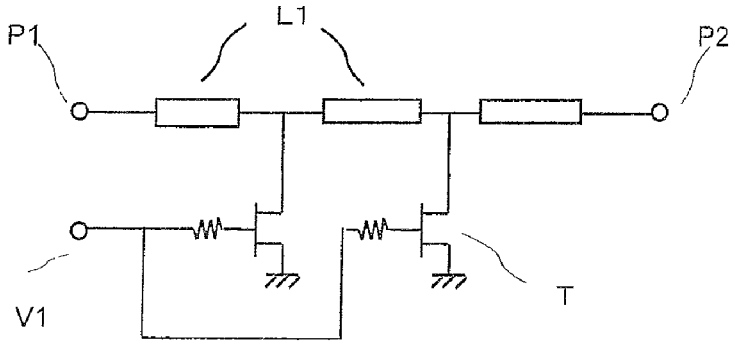
Fig. 31 PRIOR ART
FIG. 31 is a diagram showing a circuit structure of a conventional millimeter waveband switch that aims at high isolation.
Figure 32:
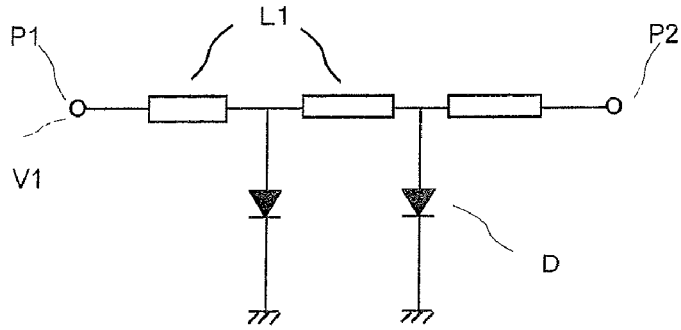
Fig. 32 PRIOR ART
FIG. 32 is a diagram showing a circuit structure of another conventional millimeter waveband switch that aims at high isolation.
Figure 33:
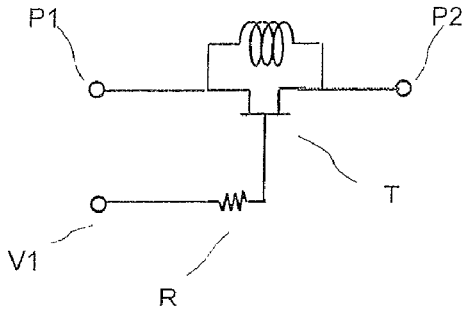
Fig. 33 PRIOR ART
FIG. 33 is a diagram showing a circuit structure of a conventional millimeter waveband switch in which inductance is arranged in series in order to aim at high isolation.

FIG. 4 shows an example of a frequency characteristic showing calculation results of the isolation when the millimeter waveband switch shown in FIG. 1 according to the first embodiment of the present invention is off. In FIG. 4, S1_off represents the calculation results of the isolation when the millimeter waveband switch shown in FIG. 1 according to the first embodiment is off (FIG. 3). Also, S2_off represents the calculation results of the isolation when the conventional millimeter waveband switch shown in FIG. 29 is off. With the use of the circuit structure according to the first embodiment, there is obtained the effect of improving the isolation on 77 GHz band.

Figure 5:
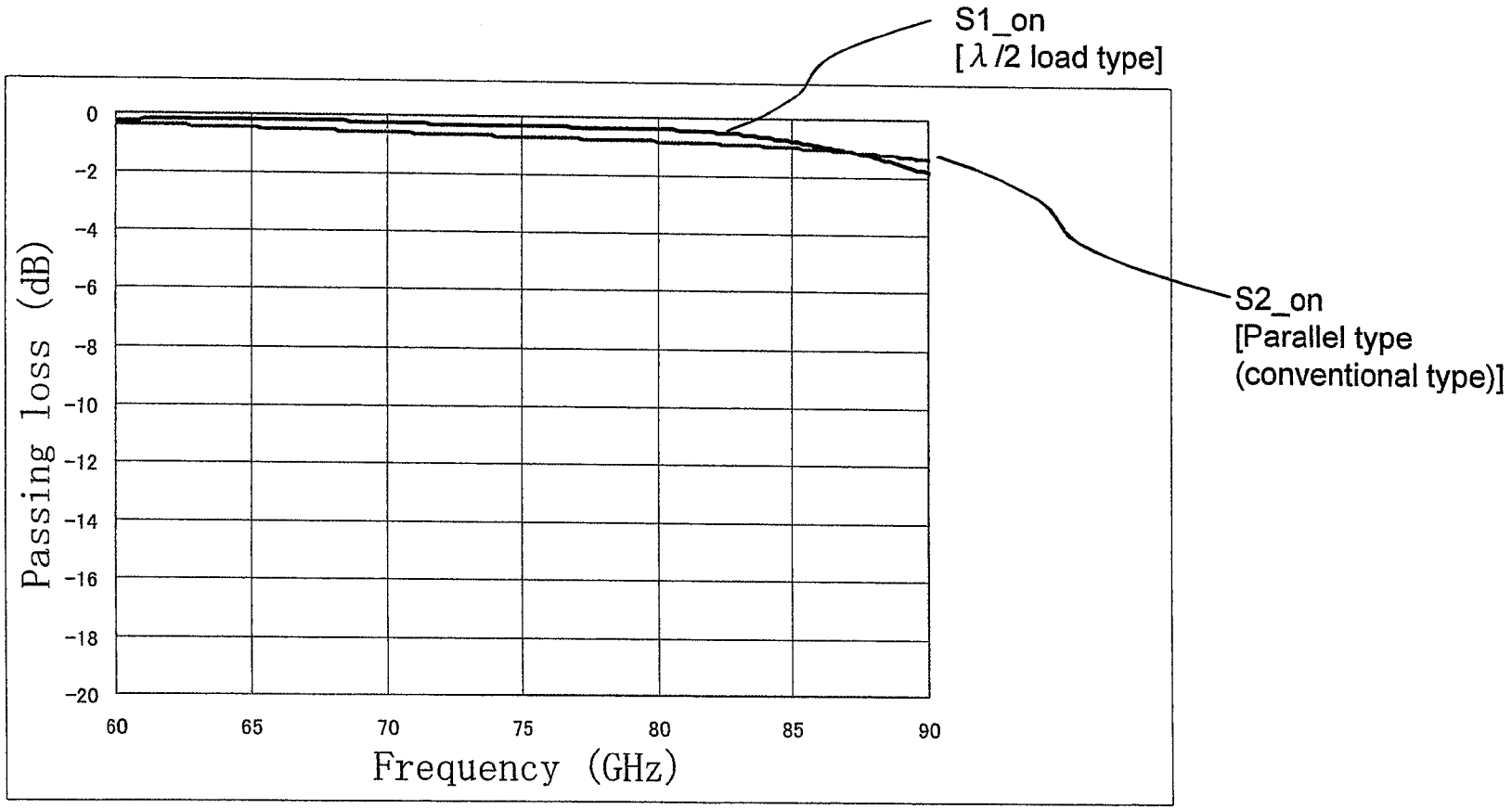

FIG. 5 shows an example of a frequency characteristic showing calculation results of the passing loss when the millimeter waveband switch shown in FIG. 1 according to the first embodiment of the present invention is on. In FIG. 5, S1_on represents the calculation results of the passing loss when the millimeter waveband switch shown in FIG. 1 according to the first embodiment is on (FIG. 2). Also, S2_on represents the calculation results of the passing loss when the conventional millimeter waveband switch shown in FIG. 29 is on. With the use of the circuit structure according to the first embodiment, there is obtained the effect of increasing no passing loss on 77 GHz band.

In fact, it is necessary to take the parasitic component of the FET into consideration on the millimeter waveband. For that reason, the length of the ½ wavelength line is required to adjust a slight increase or decrease on a desired frequency band. Similarly, in this case, the same advantage is obtained. Further, as the FET, GaAs-FET, GaN-FET, or HBT can be used.

Figure 6:
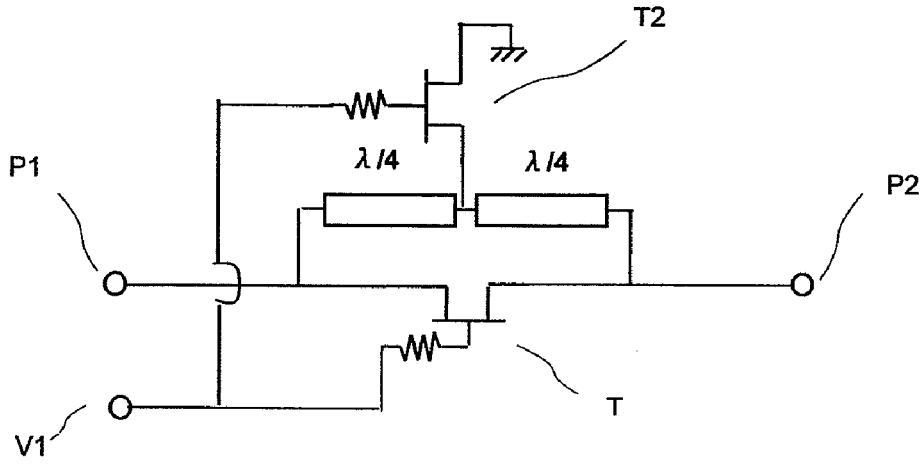
FIG. 6 is a diagram showing a second circuit structure of the millimeter waveband switch according to the first embodiment of the present invention.
Figure 7:
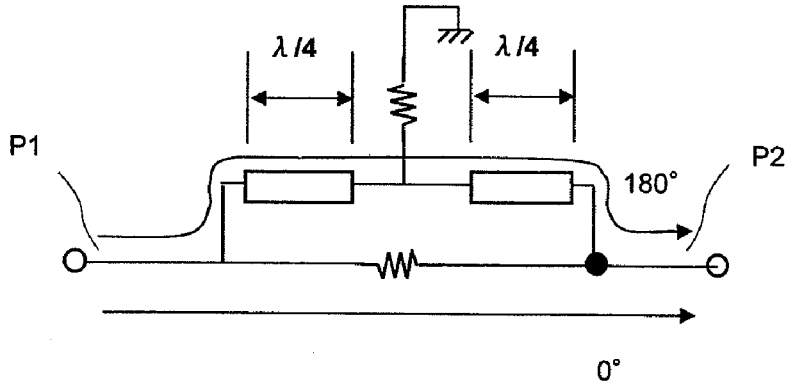
FIG. 7 shows an equivalent circuit of the millimeter waveband switch shown in FIG. 6 when the switch is off in the first embodiment of the present invention.
Figure 8:
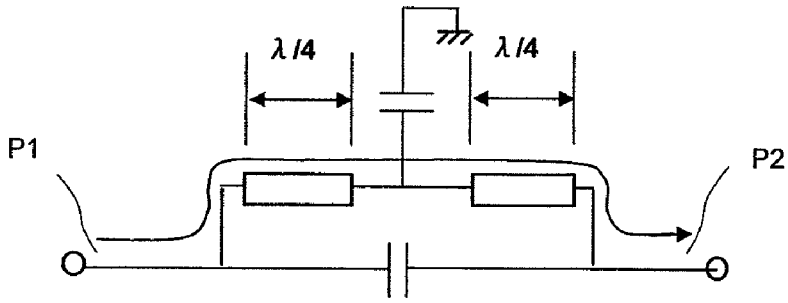
FIG. 8 shows an equivalent circuit of the millimeter waveband switch shown in FIG. 6 when the switch is on in the first embodiment of the present invention.

FIG. 6 is a diagram showing a second circuit structure of the millimeter waveband switch according to the first embodiment of the present invention. In the ½ wavelength line of the first circuit structure diagram shown in FIG. 1, the FET (T2 of FIG. 6) is used as the second switching element at a point of the ¼ wavelength. FIG. 7 shows an equivalent circuit of the millimeter waveband switch shown in FIG. 6 when the switch is off in the first embodiment of the present invention. FIG. 8 shows an equivalent circuit of the millimeter waveband switch shown in FIG. 6 when the switch is on in the first embodiment of the present invention.

When the switch is off (FIG. 7), the amplitude of the signal whose phase is delayed by 180 degrees is attenuated by the second FET (T2) and combined together, thereby enabling the isolation to be improved more than the above circuit structure shown in FIG. 1. The gate width of the second FET is selected to have substantially the same degree as the amount of attenuation caused by the first FET.

Figure 9:
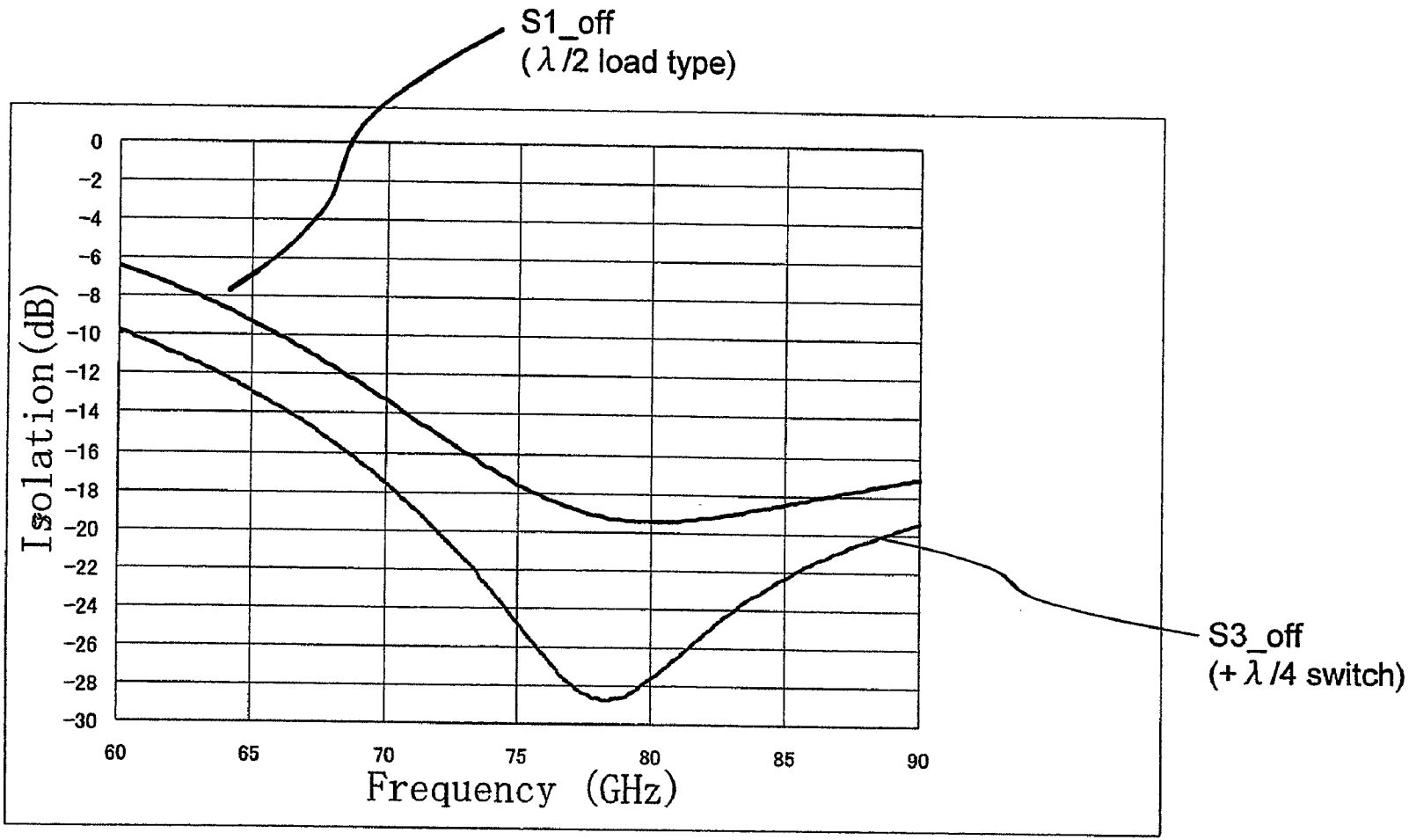
FIG. 9 shows an example of a frequency characteristic showing calculation results of isolation when the millimeter waveband switch shown in FIG. 6 according to the first embodiment of the present invention is off.

FIG. 9 shows an example of a frequency characteristic showing calculation results of the isolation when the millimeter waveband switch shown in FIG. 6 according to the first embodiment of the present invention is off. In FIG. 9, S1_off represents the calculation results of the isolation when the millimeter waveband switch shown in FIG. 1 according to the first embodiment is off (FIG. 3). Also, S3_off represents the calculation results of the isolation when the millimeter waveband switch shown in FIG. 6 according to the first embodiment is off (FIG. 7).

Figure 10:
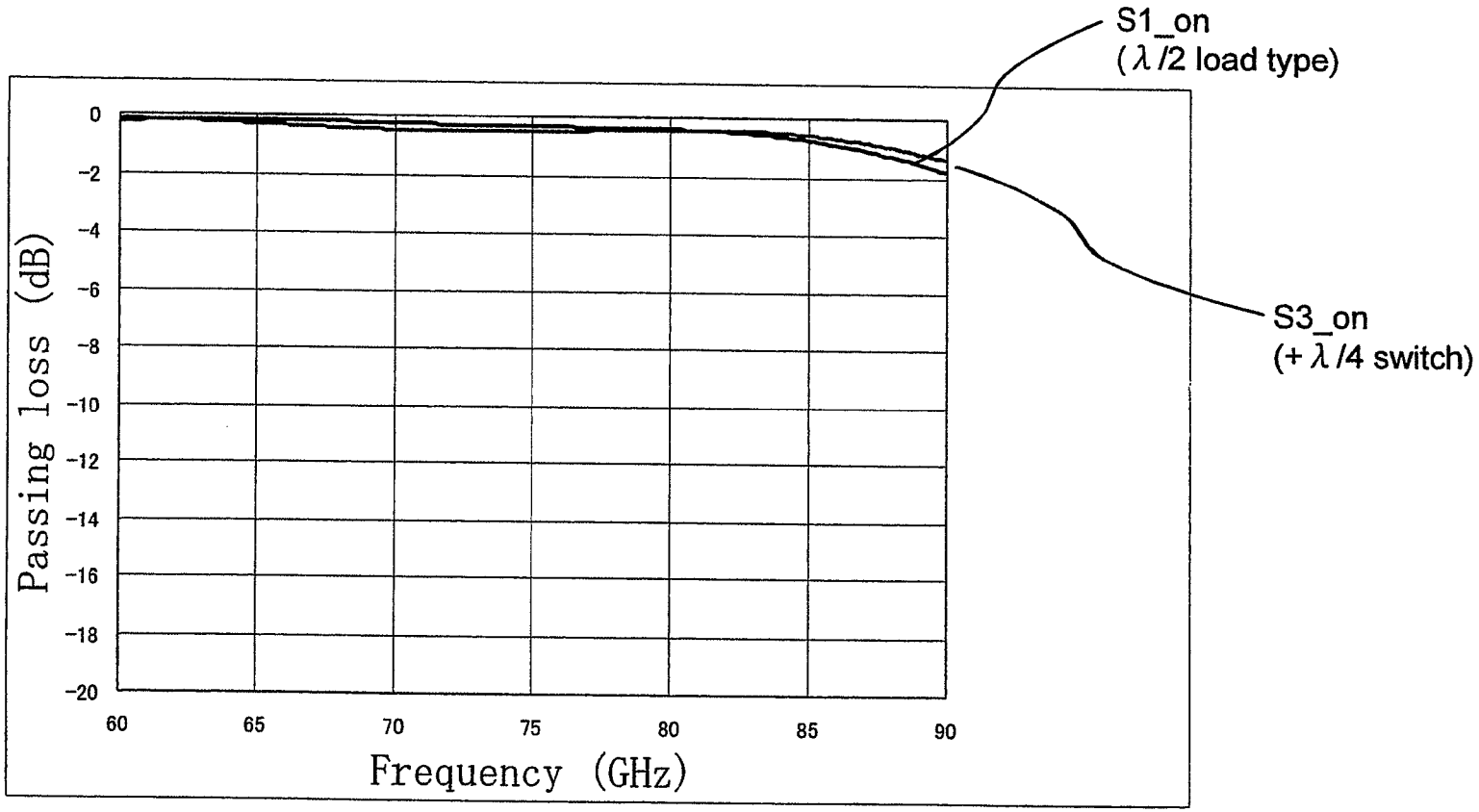

Also, FIG. 10 shows an example of a frequency characteristic showing calculation results of the passing loss when the millimeter waveband switch shown in FIG. 6 according to the first embodiment of the present invention is on. In FIG. 10, S1_on represents the calculation results of the passing loss when the millimeter waveband switch shown in FIG. 1 according to the first embodiment is on (FIG. 2). Also, S3_on represents the calculation results of the passing loss when the millimeter waveband switch shown in FIG. 6 according to the first embodiment is on (FIG. 8).

As shown in FIGS. 9 and 10, it is found that the isolation characteristic (S3_off of FIG. 9) when the millimeter waveband switch having the second circuit structure is off is increased in isolation more than the isolation characteristic (S1_off of FIG. 9) when the millimeter waveband switch having the first circuit structure is off. Also, it is found that the passing characteristic when the switch is on hardly varies.

Figure 11:
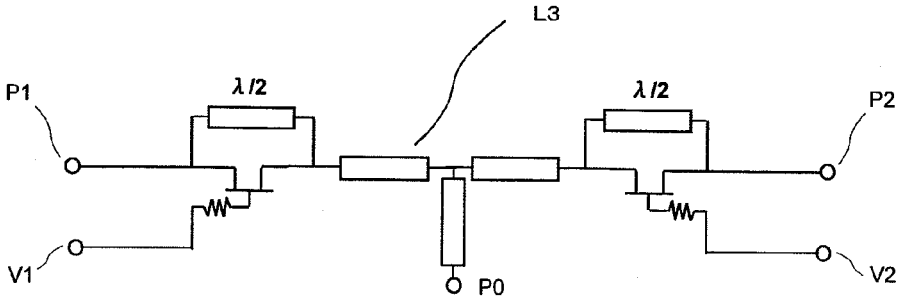
FIG. 11 is a diagram showing a third circuit structure of the millimeter waveband switch according to the first embodiment of the present invention.

FIG. 11 is a diagram showing a third circuit structure of the millimeter waveband switch according to the first embodiment of the present invention. FIG. 11 shows a structural example of a two-branch switch using the first circuit structure shown in FIG. 1. In FIG. 11, L3 represents a transmission line having a length of ¼ wavelength which is connected to a branch point. With the use of the first circuit structure shown in FIG. 1, it is possible to obtain the high isolation when the switch is off without increasing the passing loss when the switch is on even in the two-branch switch.

Figure 12:
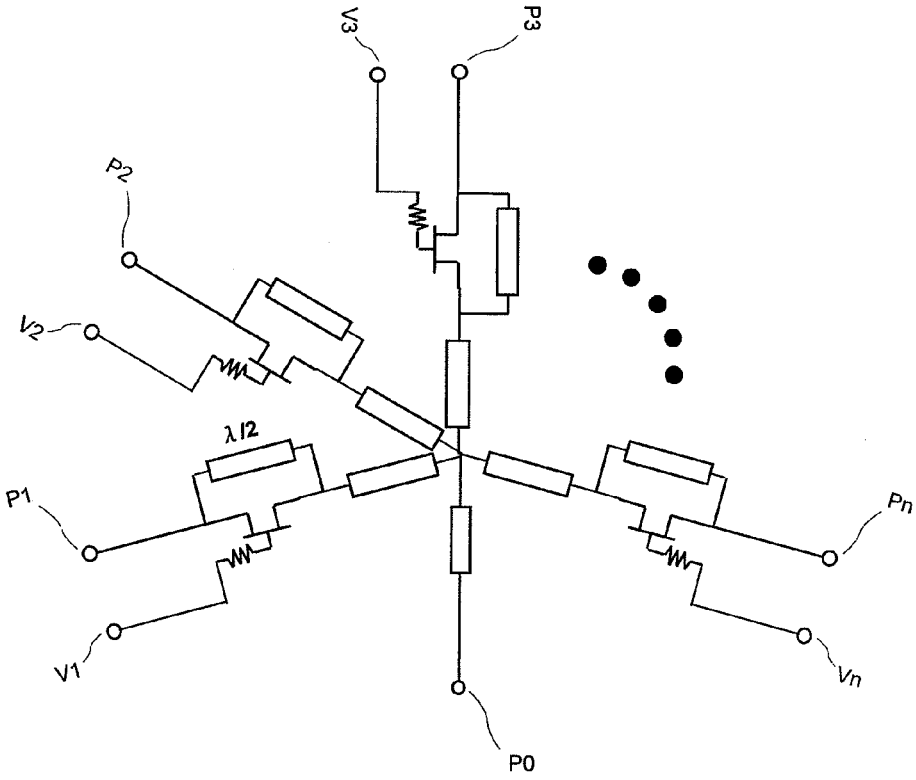
FIG. 12 is a diagram showing a fourth circuit structure of the millimeter waveband switch according to the first embodiment of the present invention.

FIG. 12 is a diagram showing a fourth circuit structure of the millimeter waveband switch according to the first embodiment of the present invention. FIG. 12 shows a structural example of an n-branch switch using the first circuit structure shown in FIG. 1. Similarly, it is possible to obtain the high isolation when the switch is off without increasing the passing loss when the switch is on even in the n-branch switch.

Figure 13:
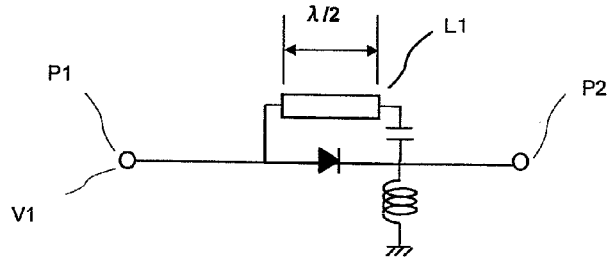
FIG. 13 is a diagram showing a fifth circuit structure of the millimeter waveband switch according to the first embodiment of the present invention.

FIG. 13 is a diagram showing a fifth circuit structure of the millimeter waveband switch according to the first embodiment of the present invention. FIG. 13 shows a structural example using a diode as the switching element in the first circuit structure shown in FIG. 1. With the use of the diode, both of the off capacitance (Coff) when the switch is off and the on-resistance (Ron) when the switch is on can be reduced more than those in the first circuit structure using the FET. As a result, the switching characteristic is obtained with lower passing loss and higher isolation.

Figure 14:
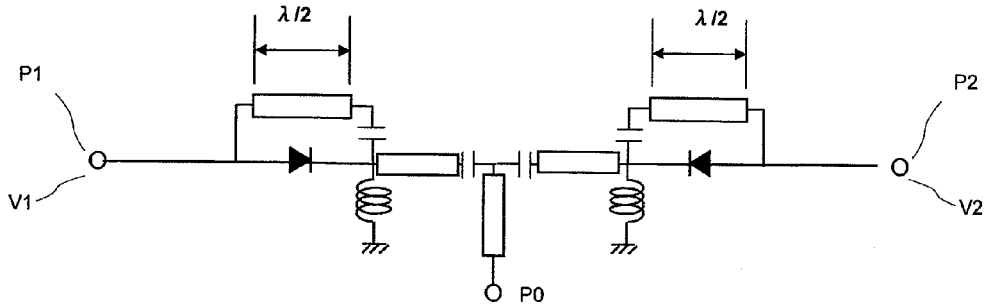
FIG. 14 is a diagram showing a sixth circuit structure of the millimeter waveband switch according to the first embodiment of the present invention.

FIG. 14 is a diagram showing a sixth circuit structure of the millimeter waveband switch according to the first embodiment of the present invention. FIG. 14 shows a structural example of a two-branch switch using the fifth circuit structure shown in FIG. 13. With the use of the fifth circuit structure shown in FIG. 13, it is possible to obtain the high isolation when the switch is off without increasing the passing loss when the switch is on even in the two-branch switch.

Figure 15:
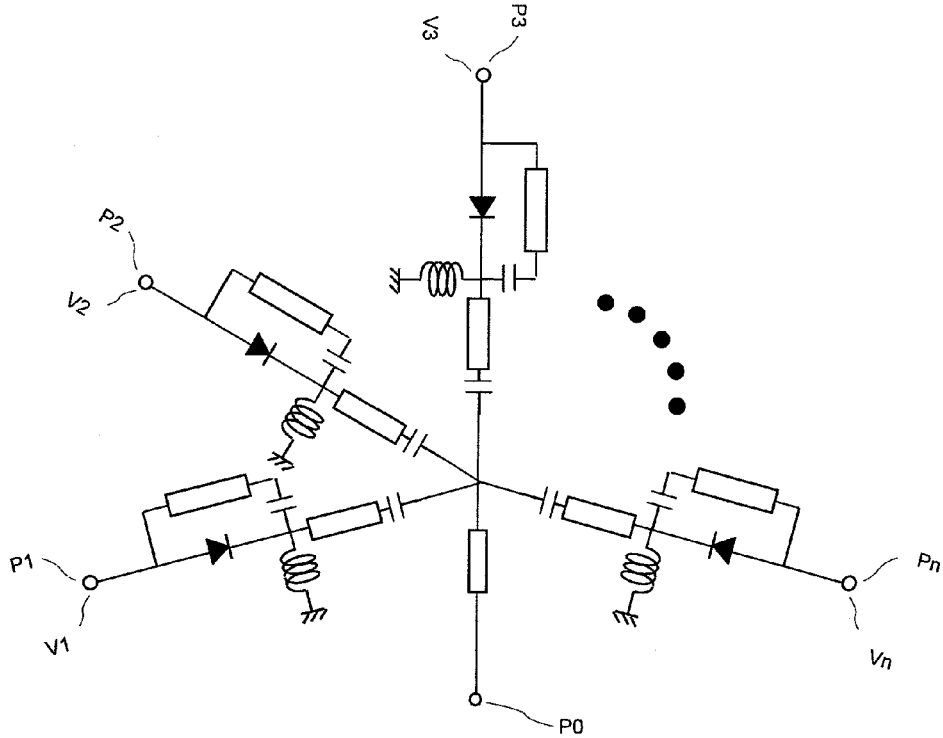
FIG. 15 is a diagram showing a seventh circuit structure of the millimeter waveband switch according to the first embodiment of the present invention.

FIG. 15 is a diagram showing a seventh circuit structure of the millimeter waveband switch according to the first embodiment of the present invention. FIG. 15 shows a structural example of an n-branch switch using the fifth circuit structure shown in FIG. 13. Similarly, with the use of the fifth circuit structure shown in FIG. 13, it is possible to obtain the high isolation when the switch is off without increasing the passing loss when the switch is on even in the n-branch switch.

Figure 16:
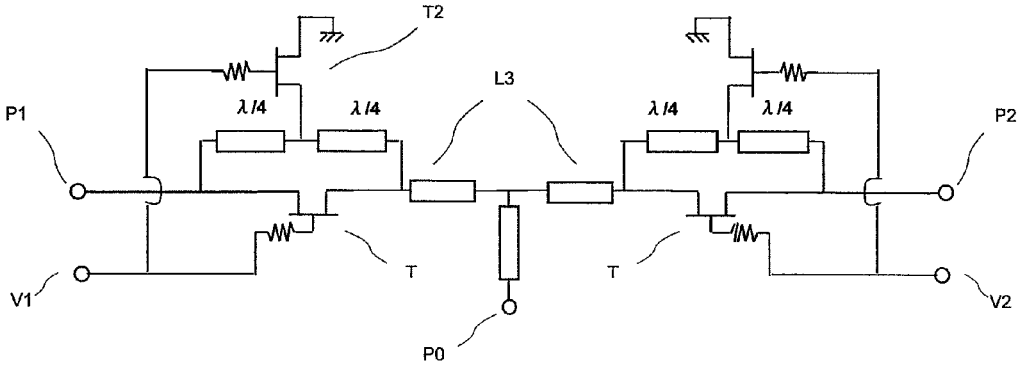
FIG. 16 is a diagram showing an eighth circuit structure of the millimeter waveband switch according to the first embodiment of the present invention.

FIG. 16 is a diagram showing an eighth circuit structure of the millimeter waveband switch according to the first embodiment of the present invention. FIG. 16 shows a structural example of a two-branch switch using the second circuit structure shown in FIG. 6. In FIG. 16, L3 represents a transmission line which is connected to a branch point. With the use of the second circuit structure shown in FIG. 6, it is possible to obtain the high isolation when the switch is off without increasing the passing loss when the switch is on even in the two-branch switch.

Figure 17:
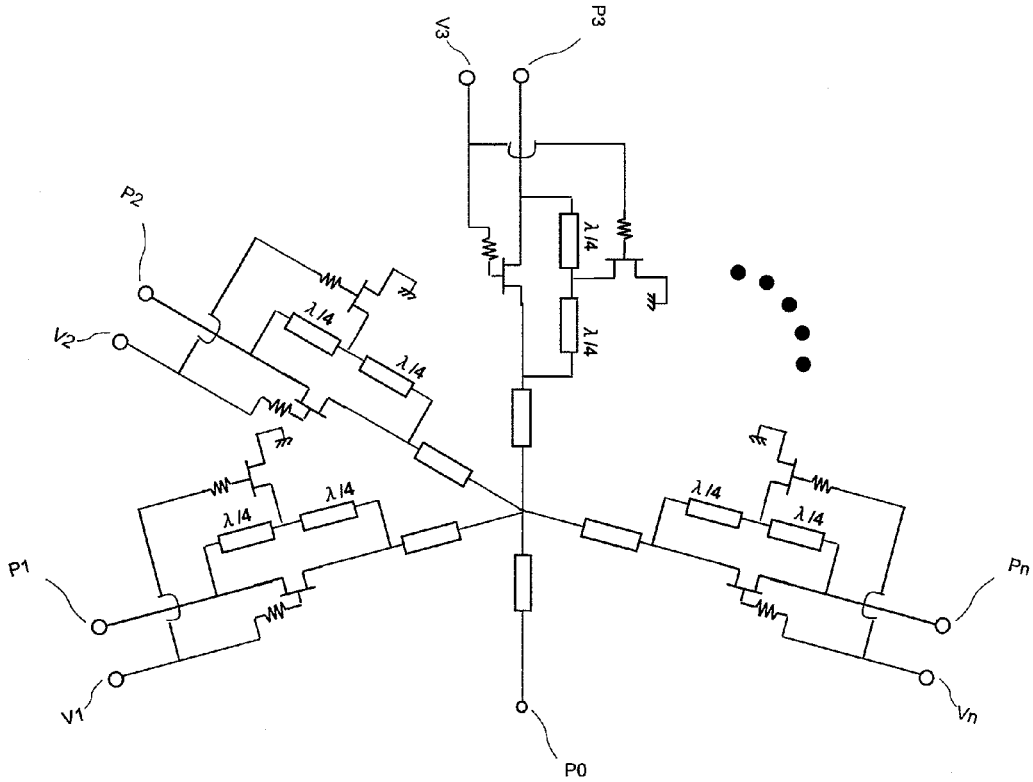
FIG. 17 is a diagram showing a ninth circuit structure of the millimeter waveband switch according to the first embodiment of the present invention.

FIG. 17 is a diagram showing a ninth circuit structure of the millimeter waveband switch according to the first embodiment of the present invention. FIG. 17 shows a structural example of an n-branch switch using the second circuit structure shown in FIG. 6. In FIG. 17, L3 represents a transmission line which is connected to a branch point. With the use of the second circuit structure shown in FIG. 6, likewise, it is possible to obtain the high isolation when the switch is off without increasing the passing loss when the switch is on even in the n-branch switch.

Figure 18:
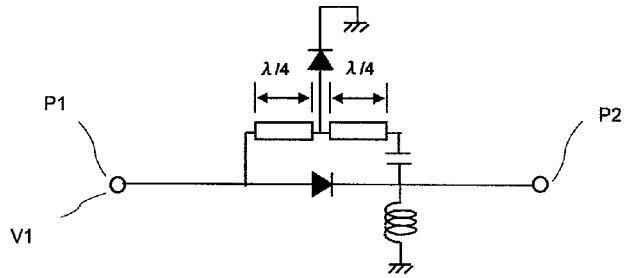
FIG. 18 is a diagram showing a tenth circuit structure of the millimeter waveband switch according to the first embodiment of the present invention.

FIG. 18 is a diagram showing a tenth circuit structure of the millimeter waveband switch according to the first embodiment of the present invention. FIG. 18 shows a structural example using a diode as the switching element in the second circuit structure shown in FIG. 6. With the use of the diode, both of the off capacitance (Coff) when the switch is off and the on-resistance (Ron) when the switch is on can be reduced more than those in the second circuit structure using the FET. As a result, the switching characteristic is obtained with lower passing loss and higher isolation.

Figure 19:
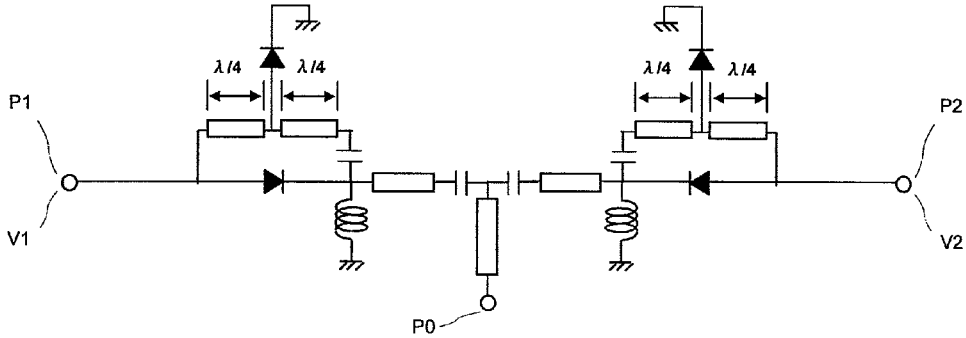
FIG. 19 is a diagram showing an eleventh circuit structure of the millimeter waveband switch according to the first embodiment of the present invention.

FIG. 19 is a diagram showing an eleventh circuit structure of the millimeter waveband switch according to the first embodiment of the present invention. FIG. 19 shows a structural example of a two-branch switch using the tenth circuit structure shown in FIG. 18. With the use of the tenth circuit structure shown in FIG. 18, it is possible to obtain the high isolation when the switch is off without increasing the passing loss when the switch is on even in the two-branch switch.

Figure 20:
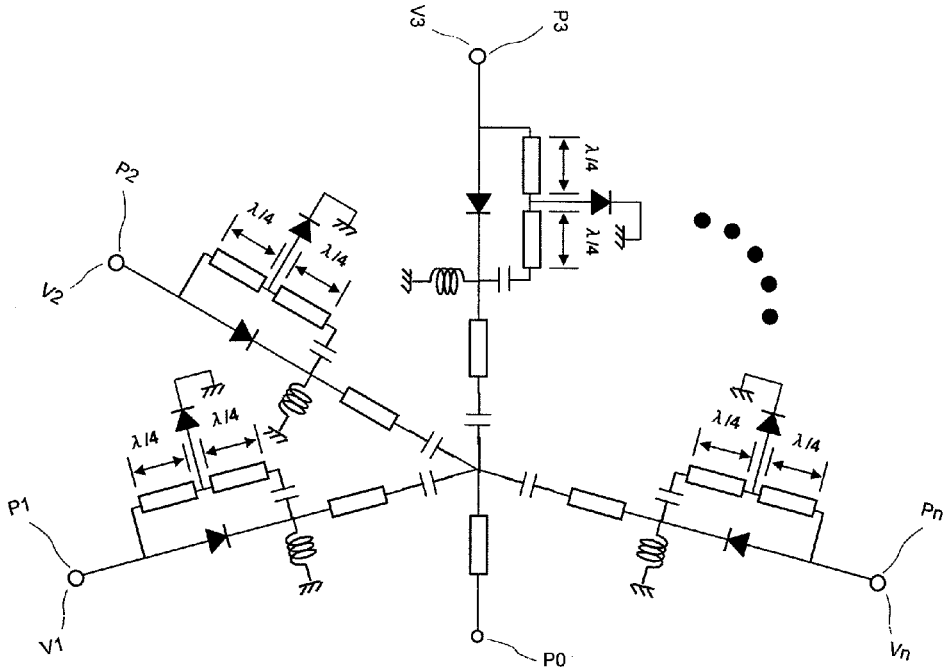
FIG. 20 is a diagram showing a twelfth circuit structure of the millimeter waveband switch according to the first embodiment of the present invention.

FIG. 20 is a diagram showing a twelfth circuit structure of the millimeter waveband switch according to the first embodiment of the present invention. FIG. 20 shows a structural example of an n-branch switch using the tenth circuit structure shown in FIG. 18. With the use of the tenth circuit structure shown in FIG. 18, it is possible to obtain the high isolation when the switch is off without increasing the passing loss when the switch is on even in the n-branch switch.

Figure 21:
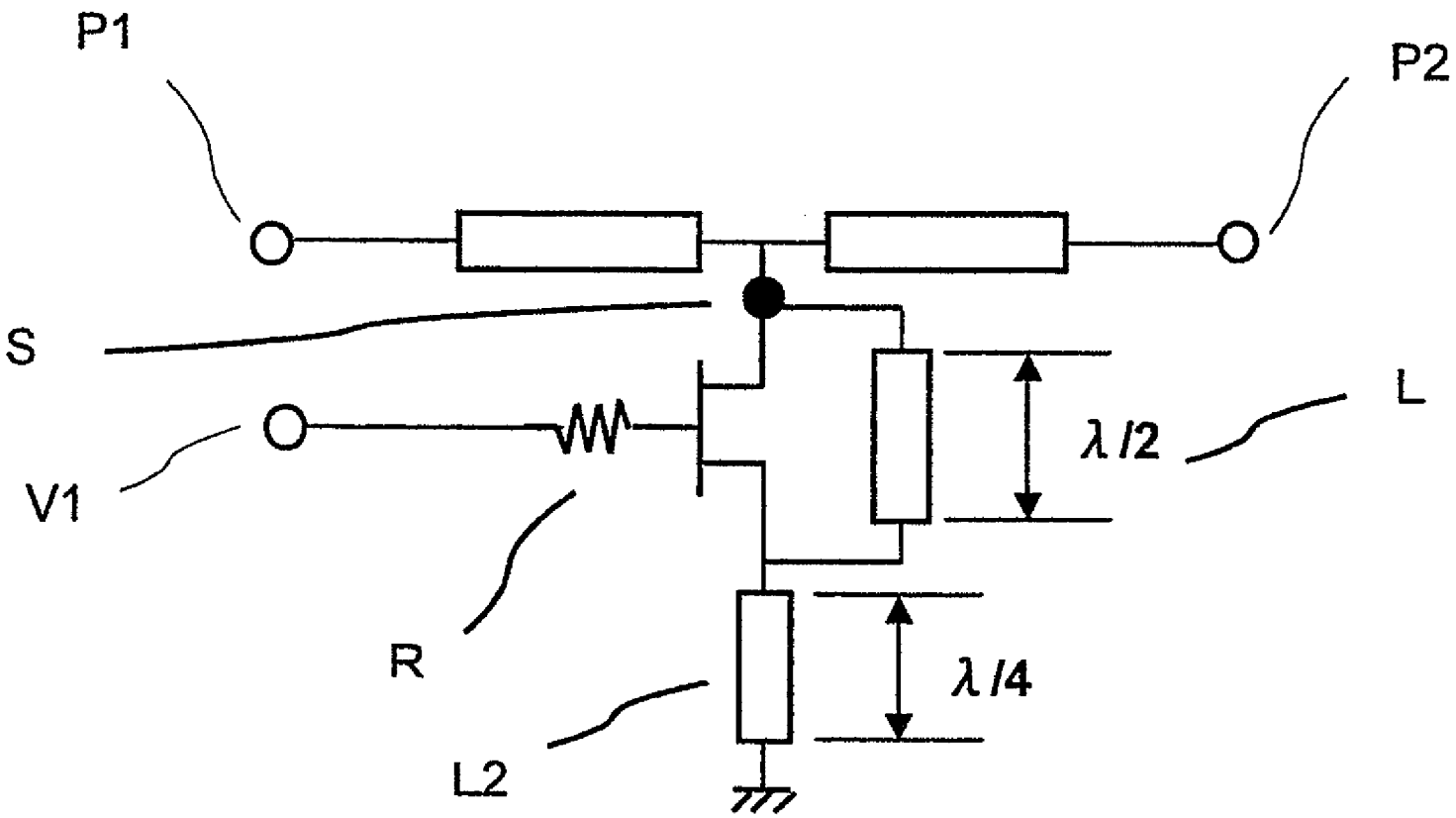
FIG. 21 is a diagram showing a thirteenth circuit structure of the millimeter waveband switch according to the first embodiment of the present invention.

FIG. 21 is a diagram showing a thirteenth circuit structure of the millimeter waveband switch according to the first embodiment of the present invention. FIG. 21 shows a modified example of the first circuit structure shown in FIG. 1. In FIG. 21, L represents a transmission line having a length of ½ wavelength, and L2 represents a transmission line having a length of ¼ wavelength. Hereinafter, a description is given of the operation of the millimeter waveband switch having the thirteenth circuit structure.

When Vc=0 V is applied to the control voltage supply terminal V1, the FET becomes the on-resistance (Ron) as with the millimeter waveband switch having the first circuit structure shown in FIG. 1. As a result, the impedance at a point S of FIG. 21 becomes small, and the signal that has been input to the input terminal P1 is blocked off.

Also, when a voltage of Vc<Vp is applied to the control voltage supply terminal V1, the FET becomes the off capacitance (Coff) as with the millimeter waveband switch having the first circuit structure shown in FIG. 1. As a result, the impedance at the point S of FIG. 21 becomes large, and the signal that has been input to the input terminal P1 passes to the output terminal P2.

Figure 22:
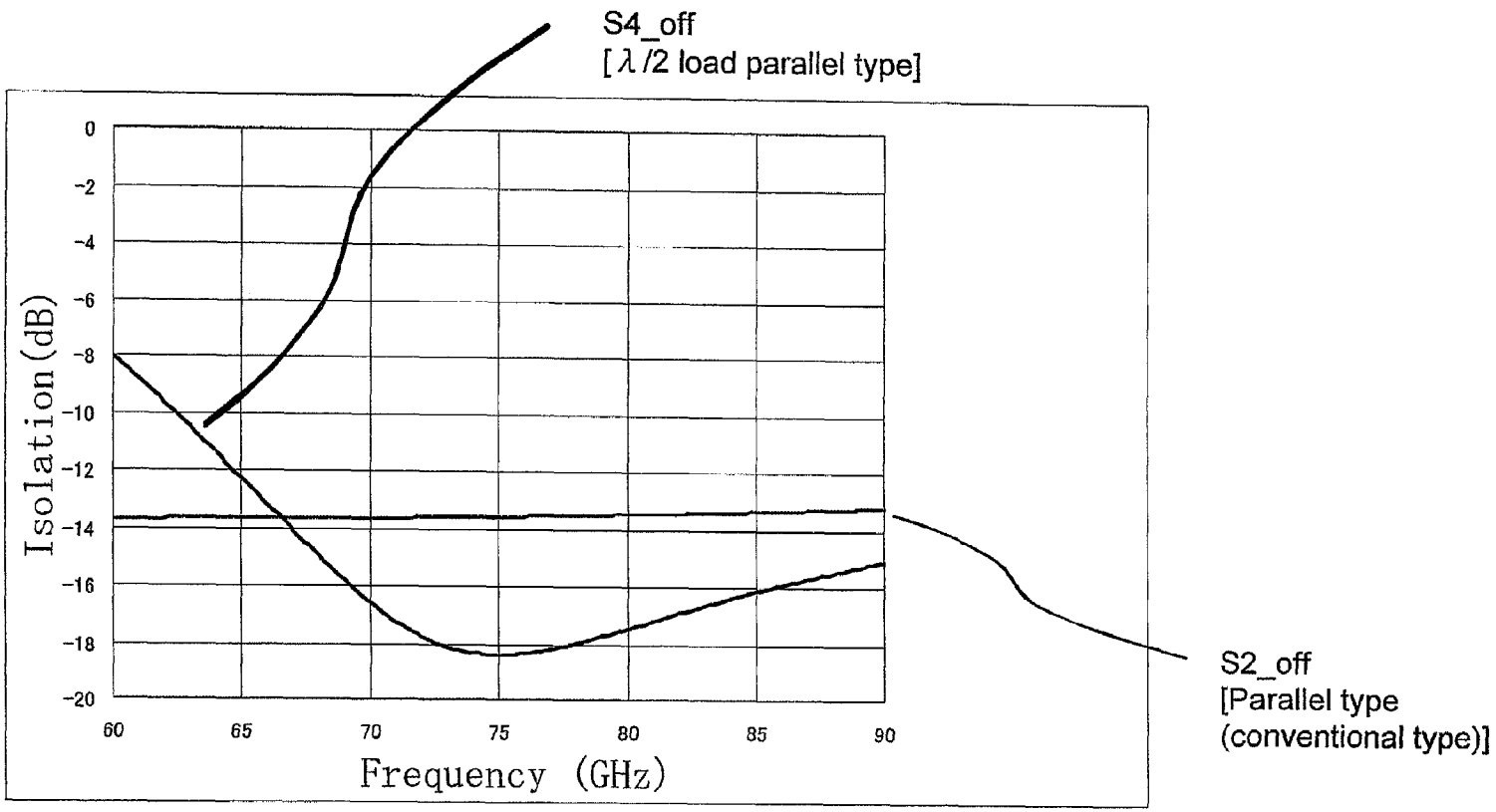
FIG. 22 shows an example of a frequency characteristic showing calculation results of isolation when the millimeter waveband switch shown in FIG. 21 according to the first embodiment of the present invention is off.

FIG. 22 shows an example of a frequency characteristic showing calculation results of the isolation when the millimeter waveband switch shown in FIG. 21 according to the first embodiment of the present invention is off. In FIG. 22, S4_off represents the calculation results of the isolation when the millimeter waveband switch shown in FIG. 21 according to the first embodiment is off. Also, S2_off represents the calculation results of the isolation when the conventional millimeter waveband switch shown in FIG. 29 is off.

Figure 23:
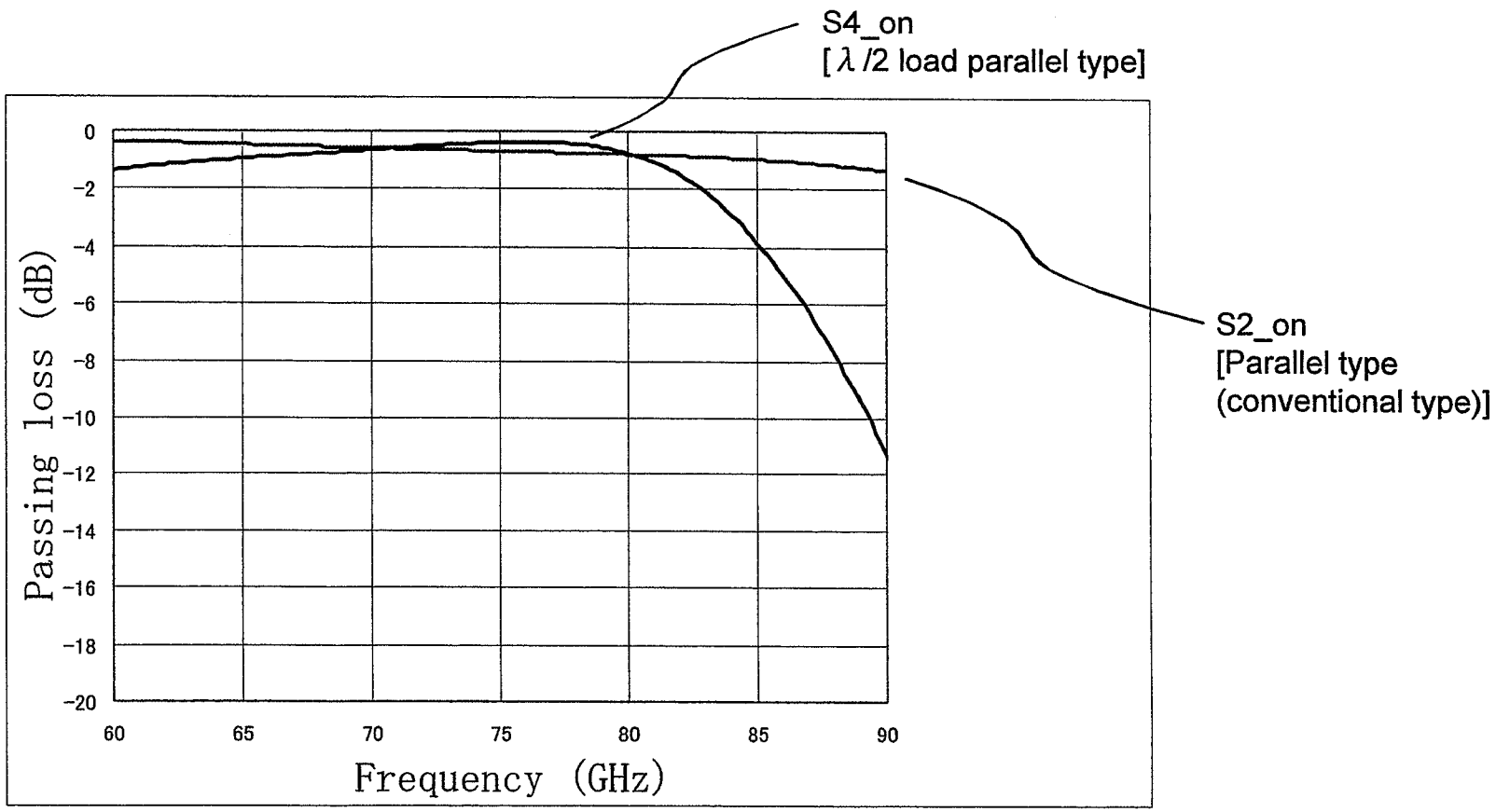

Also, FIG. 23 shows an example of a frequency characteristic showing calculation results of the passing loss when the millimeter waveband switch shown in FIG. 21 according to the first embodiment of the present invention is on. In FIG. 23, S4_on represents the calculation results of the passing loss when the millimeter waveband switch shown in FIG. 21 according to the first embodiment is on. Also, S2_on represents the calculation results of the passing loss when the conventional millimeter waveband switch shown in FIG. 29 is on.

Similarly, with the use of the thirteenth circuit structure shown in FIG. 21, the isolation (S4_off of FIG. 22) when the switch is off increases more than that of the conventional example, and the passing loss (S4_on of FIG. 23) when the switch is on can obtain substantially the same performance as that of the conventional example.

Figure 24:
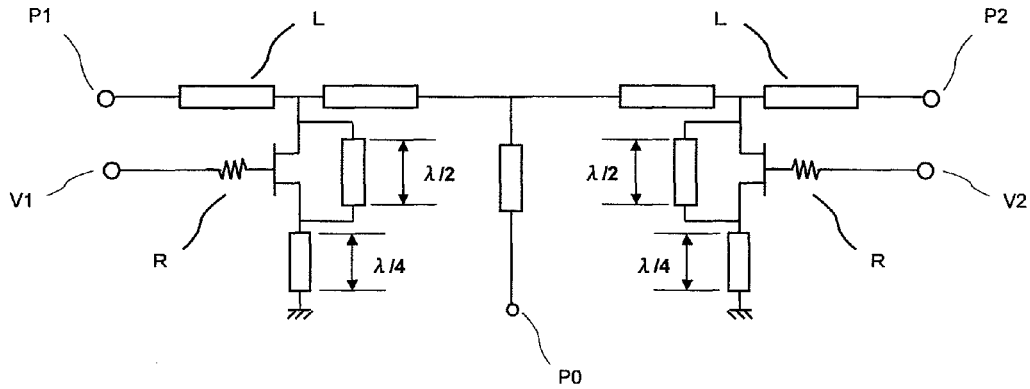
FIG. 24 is a diagram showing a fourteenth circuit structure of the millimeter waveband switch according to the first embodiment of the present invention.

FIG. 24 is a diagram showing a fourteenth circuit structure of the millimeter waveband switch according to the first embodiment of the present invention. FIG. 24 shows a structural example of a two-branch switch using the thirteenth circuit structure shown in FIG. 21. With the use of the thirteenth circuit structure shown in FIG. 21, it is possible to obtain the high isolation when the switch is off without increasing the passing loss when the switch is on even in the two-branch switch.

Figure 25:
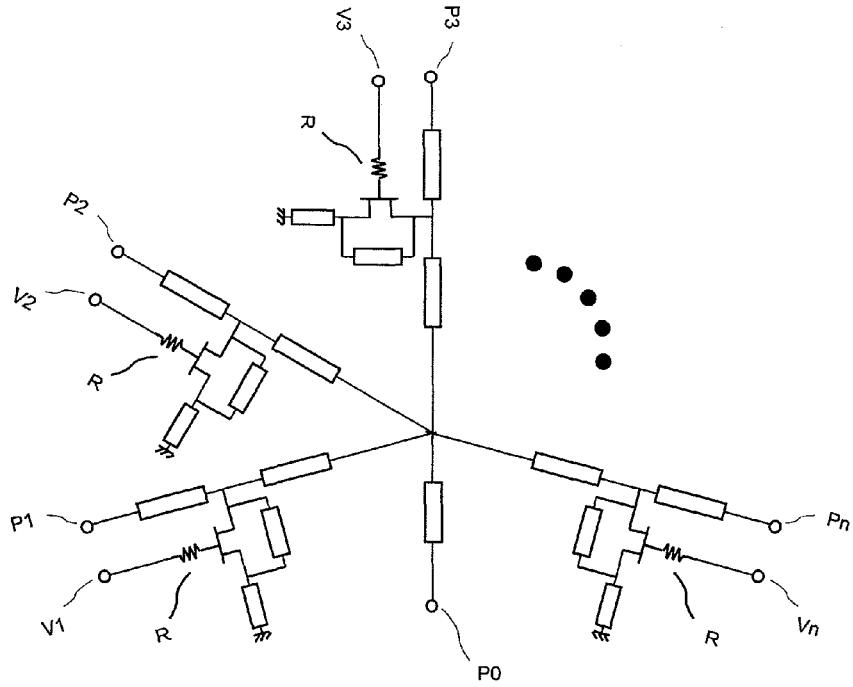
FIG. 25 is a diagram showing a fifteenth circuit structure of the millimeter waveband switch according to the first embodiment of the present invention.

FIG. 25 is a diagram showing a fifteenth circuit structure of the millimeter waveband switch according to the first embodiment of the present invention. FIG. 25 shows a structural example of an n-branch switch using the thirteenth circuit structure shown in FIG. 21. Likewise, it is possible to obtain the high isolation when the switch is off without increasing the passing loss when the switch is on even in the n-branch switch.

Figure 26:
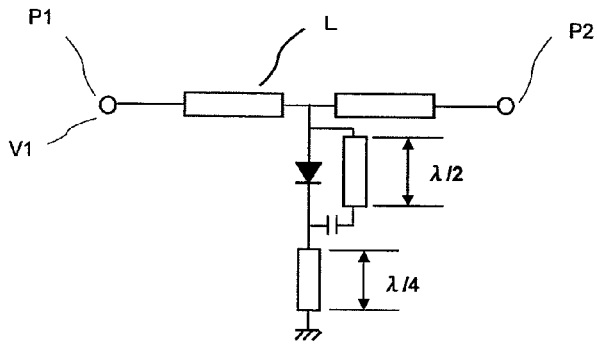
FIG. 26 is a diagram showing a sixteenth circuit structure of the millimeter waveband switch according to the first embodiment of the present invention.

FIG. 26 is a diagram showing a sixteenth circuit structure of the millimeter waveband switch according to the first embodiment of the present invention. FIG. 26 shows a structural example using a diode as the switching element in the thirteenth circuit structure shown in FIG. 21. With the use of the diode as the switching element, likewise, the switching characteristic can be obtained with lower passing loss and higher isolation.

Figure 27:
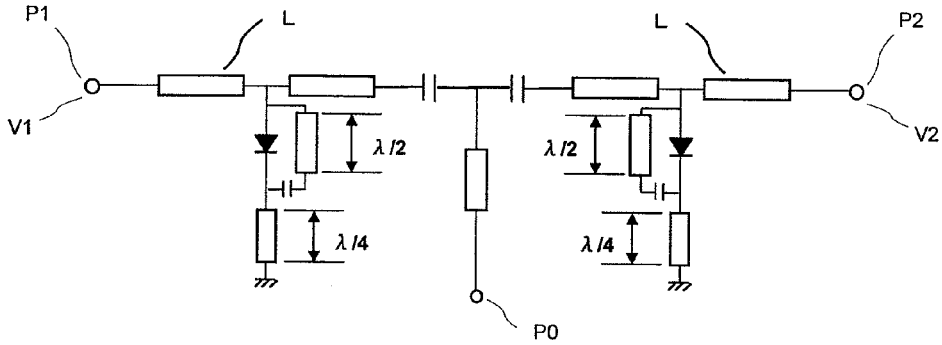
FIG. 27 is a diagram showing a seventeenth circuit structure of the millimeter waveband switch according to the first embodiment of the present invention.

FIG. 27 is a diagram showing a seventeenth circuit structure of the millimeter waveband switch according to the first embodiment of the present invention. FIG. 27 shows a structural example of a two-branch switch using the sixteenth circuit structure shown in FIG. 26. With the use of the sixteenth circuit structure shown in FIG. 26, it is possible to obtain the high isolation when the switch is off without increasing the passing loss when the switch is on even in the two-branch switch.

Figure 28:
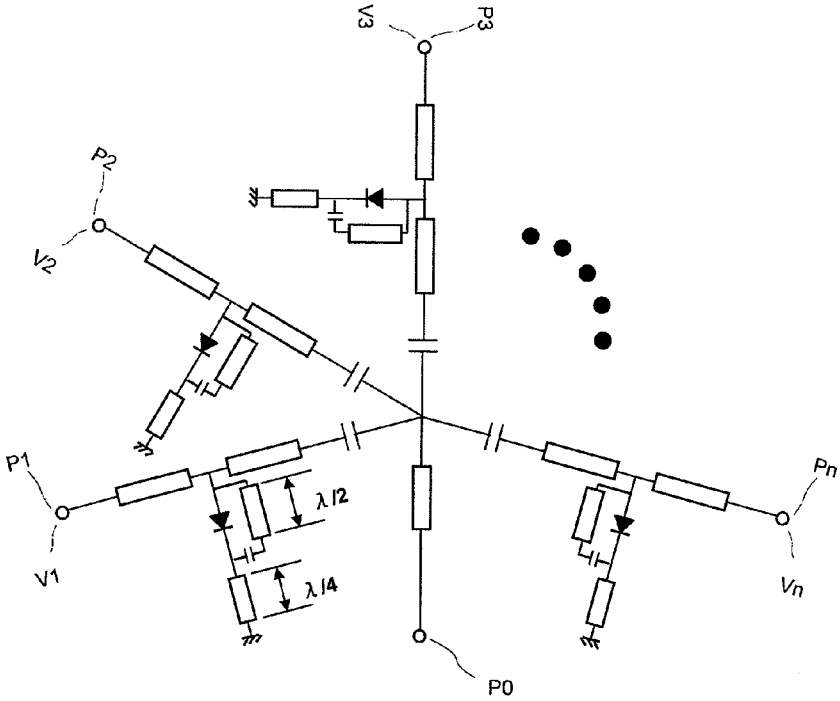
FIG. 28 is a diagram showing an eighteenth circuit structure of the millimeter waveband switch according to the first embodiment of the present invention.

FIG. 28 is a diagram showing an eighteenth circuit structure of the millimeter waveband switch according to the first embodiment of the present invention. FIG. 28 shows a structural example of an n-branch switch using the sixteenth circuit structure shown in FIG. 26. With the use of the sixteenth circuit structure shown in FIG. 26, it is similarly possible to obtain the high isolation when the switch is off without increasing the passing loss when the switch is on even in the n-branch switch.

As has been described above, according to the first embodiment, the parallel circuit including the transmission line having the electric length of ½ wavelength and the switching element is connected in parallel or in series between the input and output terminals through which the signal passes, thereby making it possible to obtain the millimeter waveband switch that enables the high isolation without increasing the passing loss.

What is claimed is:

1. A millimeter waveband switch, comprising:

a first switching element that is connected in series between input and output terminals through which a signal passes; and a first transmission line having an electrical length of ½ wavelength and which is connected in parallel with the first switching element.

2. The millimeter waveband switch according to claim 1, further comprising a second switching element that is connected between ground and an electrical midpoint of the first transmission line.

3. A millimeter waveband switch, comprising n (wherein n is an integer and at least 2) of the millimeter waveband switches according to claim 1 connected to constitute an n-branch changeover switch.

4. The millimeter waveband switch according to claim 1, wherein the switching element comprises one of a field effect transistor and a diode.

5. A millimeter waveband switch, comprising n (wherein n is an integer and at least 2) of the millimeter waveband switches according to claim 2 connected to constitute an n-branch changeover switch.

6. The millimeter waveband switch according to claim 2, wherein the switching element comprises one of a field effect transistor and a diode.

7. The millimeter waveband switch according to claim 3, wherein the switching element comprises one of a field effect transistor and a diode.

* * * * *